US009342022B2

(12) United States Patent
Ishida

(10) Patent No.: US 9,342,022 B2
(45) Date of Patent: May 17, 2016

(54) DOCUMENT TRANSPORTING DEVICE AND IMAGE FORMING APPARATUS

(75) Inventor: Mitsuyuki Ishida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 319 days.

(21) Appl. No.: 13/021,253

(22) Filed: Feb. 4, 2011

(65) Prior Publication Data

US 2012/0070212 A1 Mar. 22, 2012

(30) Foreign Application Priority Data

Sep. 17, 2010 (JP) ..... 2010-209766

(51) Int. Cl.
*B65H 29/26* (2006.01)
*B65H 31/26* (2006.01)
*G03G 15/00* (2006.01)

(52) U.S. Cl.
CPC ..... *G03G 15/6552* (2013.01); *B65H 31/26* (2013.01); *B65H 2401/1141* (2013.01); *B65H 2404/14* (2013.01); *B65H 2801/06* (2013.01); *G03G 2215/00421* (2013.01)

(58) Field of Classification Search
CPC ..... B65H 31/26; B65H 2401/1141; B65H 31/00; B65H 29/26; B65H 2404/61; G03G 2215/00421
USPC ..... 399/377, 405, 365, 406, 367, 368, 369; 400/625; 271/220, 223
See application file for complete search history.

(56) References Cited

U.S. PATENT DOCUMENTS 4,469,319 A * 9/1984 Robb ..... B65H 3/042 271/171
4,789,150 A * 12/1988 Plain ..... B65H 29/14 271/220

(Continued)

FOREIGN PATENT DOCUMENTS

CN 100440056 C 12/2008
CN 100540429 C 9/2009

(Continued)

OTHER PUBLICATIONS

Office Action dated Nov. 5, 2013, issued by the Japanese Patent Office in counterpart Japanese Patent Application No. 2010-209766.

(Continued)

*Primary Examiner* — Jennifer Simmons
(74) *Attorney, Agent, or Firm* — Sughrue Mion, PLLC

(57) ABSTRACT

A document transporting device includes: a document-accommodating section; a transporting mechanism; a document-discharge section; a holding member that includes an attach-portion that is attached at an upper side of a discharge-port from which a document is discharged to the document-discharge section, and holding portion main-bodies provided such that lower ends are contacted with the document-discharge section, that hold down the document discharged on the document-discharge section from above, a length in a discharge-direction of the document from an attachment-position of the attach-portion to the lower end of the holding portion main-body being longer than a height from the document-discharge section to the attachment-position of the attach-portion; and protruding portions formed in the document-discharge section along a longitudinal direction of the discharge-port such that a top portion of the protruding portion is positioned at a downstream side of the discharge-direction relative to the lower end of the holding portion main-body.

1 Claim, 9 Drawing Sheets

(56) References Cited

U.S. PATENT DOCUMENTS

| | | | | |
|---|---|---|---|---|
| 2005/0281598 | A1* | 12/2005 | Hattori et al. | 399/405 |
| 2006/0017219 | A1* | 1/2006 | Yamada | 271/209 |
| 2006/0222434 | A1 | 10/2006 | Kitamura et al. | |
| 2009/0218750 | A1 | 9/2009 | Shingai | |
| 2010/0150630 | A1 | 6/2010 | Kitamura et al. | |

FOREIGN PATENT DOCUMENTS

| | | | | | |
|---|---|---|---|---|---|
| JP | H09255210 | A | | 9/1977 | |
| JP | 2000-238955 | | | 9/2000 | |
| JP | 2004026370 | A | | 1/2004 | |
| JP | 2004115254 | A | | 4/2004 | |
| JP | 2006027758 | A | | 2/2006 | |
| JP | 2007112524 | A | | 5/2007 | |
| JP | 2008120494 | A | * | 5/2008 | |
| JP | 2009037390 | A | * | 2/2009 | B65H 31/02 |
| JP | 2009-203063 | | | 9/2009 | |

OTHER PUBLICATIONS

Japanese Office Action dated Mar. 25, 2014 issued in Japanese Patent Application No. 2010-209766.

Communication dated Sep. 3, 2014, issued by the State Intellectual Property Office of China in corresponding Chinese Application No. 201110063253.X.

* cited by examiner

DOCUMENT TRANSPORTING DEVICE AND IMAGE FORMING APPARATUS

CROSS-REFERENCE TO RELATED APPLICATION

This application is based on and claims priority under 35 USC 119 from Japanese Patent Application No. 2010-209766 filed Sep. 17, 2010.

BACKGROUND

Technical Field

The present invention relates to a document transporting device and an image forming apparatus.

SUMMARY

A document transporting device according to an aspect of the invention includes: a document accommodating section in which a document is accommodated; a transporting mechanism that transports the document accommodated in the document accommodating section along a transporting path; a document discharge section to which the document transported in the transporting path by the transporting mechanism is discharged; a holding member that includes an attach portion that is attached at an upper side of a discharge port from which the document is discharged to the document discharge section, and holding portion main bodies provided such that lower ends thereof are contacted with the document discharge section, that hold down the document discharged on the document discharge section from above, a length in a discharge direction of the document, from an attachment position of the attach portion to the lower end of the holding portion main body, being longer than a height from the document discharge section to the attachment position of the attach portion; and protruding portions that are formed in the document discharge section along a longitudinal direction of the discharge port such that a top portion of the protruding portion is positioned at a downstream side of the discharge direction of the document relative to the lower end of the holding portion main body.

BRIEF DESCRIPTION OF THE DRAWINGS

Exemplary embodiments of the invention will be described in detail with reference to the following figures, wherein.

DETAILED DESCRIPTION

Figure 1:
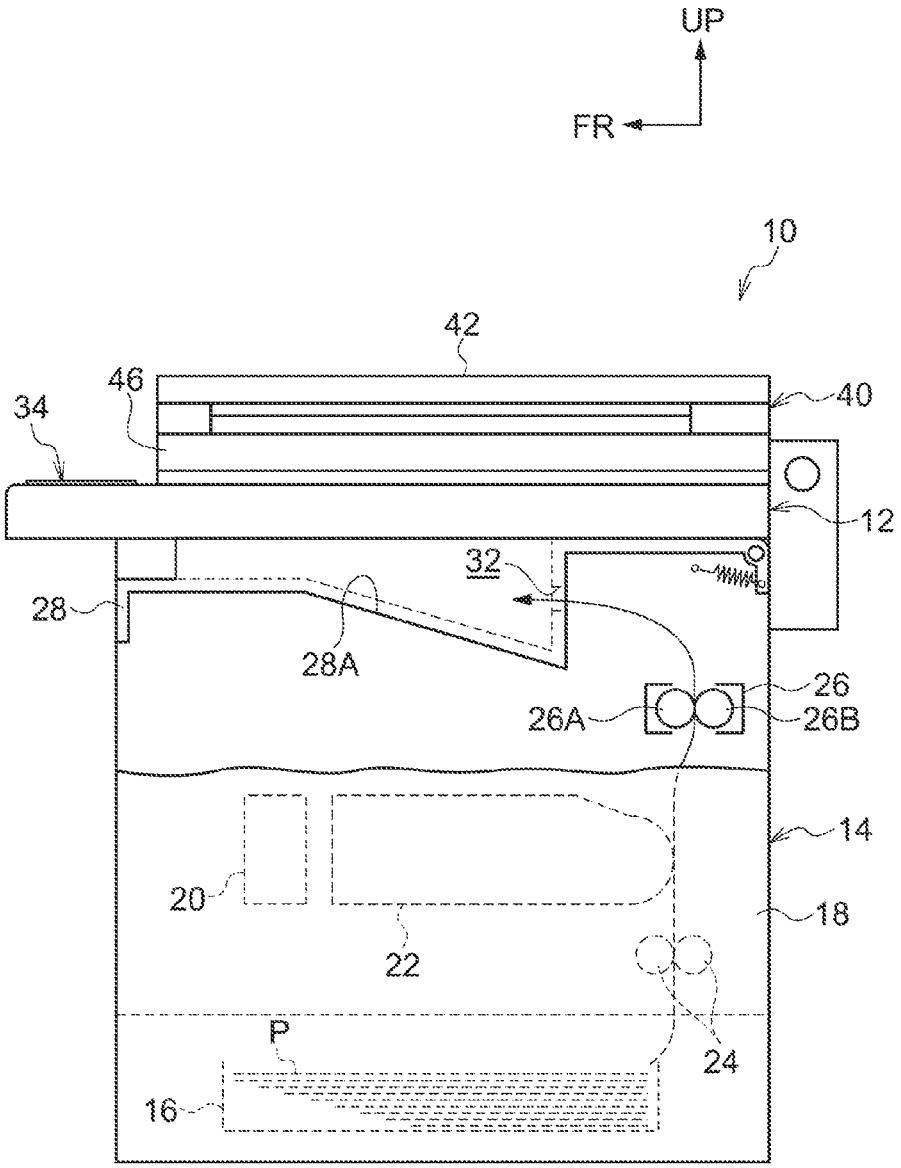
FIG. 1 is a schematic side view showing a structure of an image forming apparatus.
Figure 2:
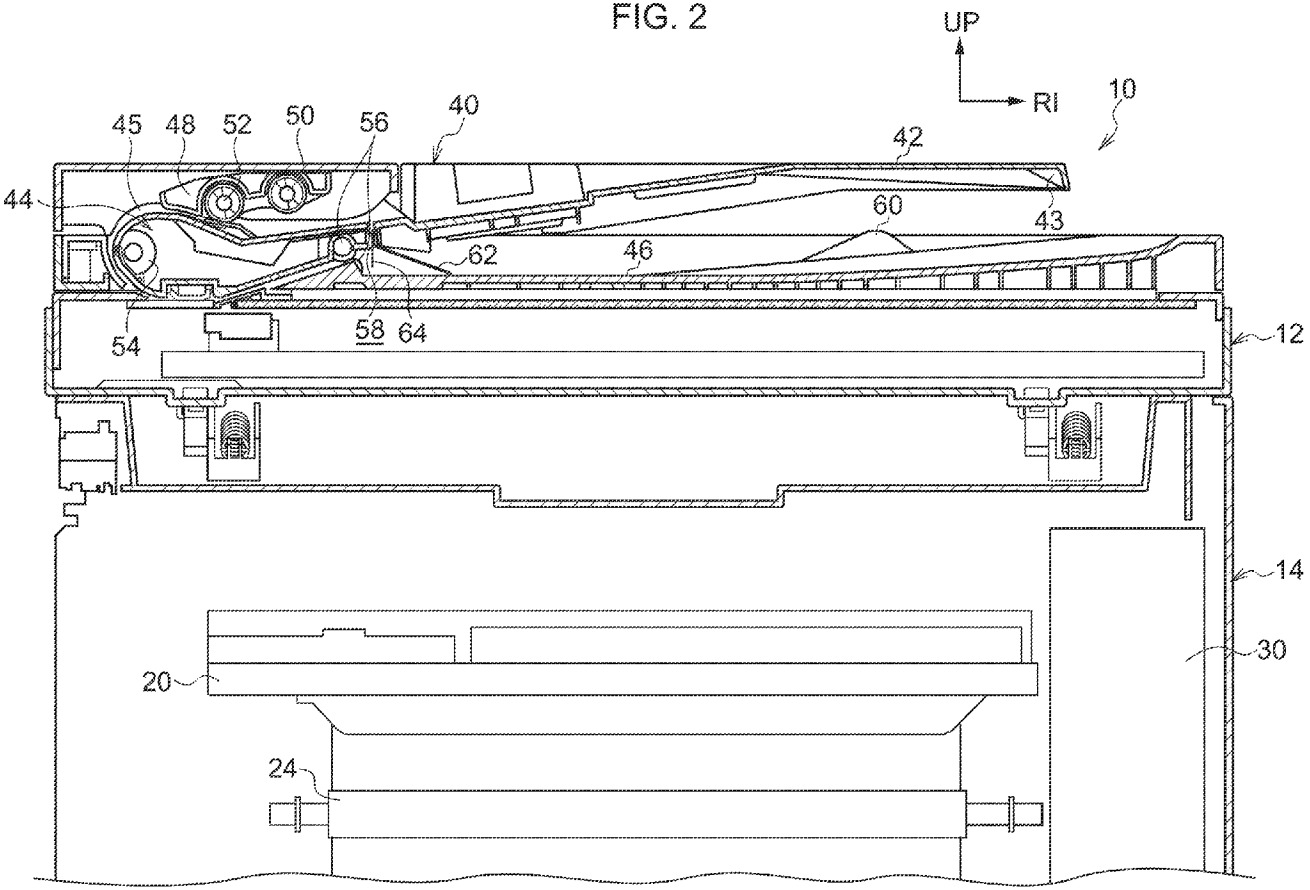
FIG. 2 is a schematic front view showing the structure of the image forming apparatus.

An exemplary embodiment according to the present invention will be described below in detail with reference to the drawings. In FIG. 1, the arrow UP denotes the upward direction of an image forming apparatus 10 and the arrow FR denotes a forward direction of the image forming apparatus 10. In FIG. 2, the arrow RI denotes the right direction of the image forming apparatus 10 which is a discharge direction of a document G (see FIG. 9). In the exemplary embodiment, a recording sheet P (see FIG. 1) is used as one example of a recording medium on which an image is formed.

As shown in FIGS. 1 and 2, the image forming apparatus 10 includes a document transporting section 40 as one example of a document transporting device that transports a document G, a document reading section 12 that reads image information of the document G, and a main body 14 arranged below the document reading section 12. The document transporting section 40 will be described below in detail.

The main body 14 is configured to form an image on the recording sheet P based on the image information read by the document reading section 12, and includes a sheet supplying tray 16 arranged at its lower portion, and an image forming section 18, arranged at the upper portion of the sheet supplying tray 16, that forms an image. The image forming section 18 includes an exposing device 20 and an image forming unit 22.

The exposing device 20 emits a light beam such that, based on the image information read by the document reading section 12, a light beam emitted from a light source (not shown in the drawings) is scanned (deflected) by a rotational polygon mirror and is reflected on plural optical components such as reflecting mirror. The light beam is guided to a corresponding photoreceptor drum.

The image forming unit 22 includes the photoreceptor drum (not shown in the drawings), a charging roll, a cleaner, a transfer roll, a developing device and the like, and the sheet supplying tray 16 is arranged below the image forming unit 22. A pair of registering rolls 24 that adjusts the position of a tip end portion of the recording sheet P is arranged the rear side and the upper side of the sheet supplying tray 16.

A fixing device 26 is arranged at the downstream side in the transporting direction of the recording sheet P with respect to the image forming unit 22. The fixing device 26 includes a heating roll 26A and a pressurizing roll 26B, and the fixing device 26 fixes a toner image transferred on the recording sheet P by heating and pressurizing the recording sheet P on the recording sheet P.

The upper portion of the image forming section 18, which is at the downstream side in the transporting direction of the recording sheet P with respect to the fixing device 26, is covered with an openable/closable cover member 28. The recording sheet P is discharged from a discharge port 32 provided at the downstream side in the transporting direction of the recording sheet P with respect to the fixing device 26 to an upper surface 28A of the cover member 28. The main body 14 is provided with a controlling section 30 that controls operations of the respective sections.

The document reading section 12 is arranged at the main body 14 at its upper portion. At the document reading section 12 at its front face, an operation panel unit 34 is provided. The operation panel unit 34 is provided with a display section 36 and an operating section 38 including numerical keys, a start button and the like, by which an operator inputs/performs reading of image information of the document G, copying instruction and the like, as detailed in FIG. 4.

Figure 3:
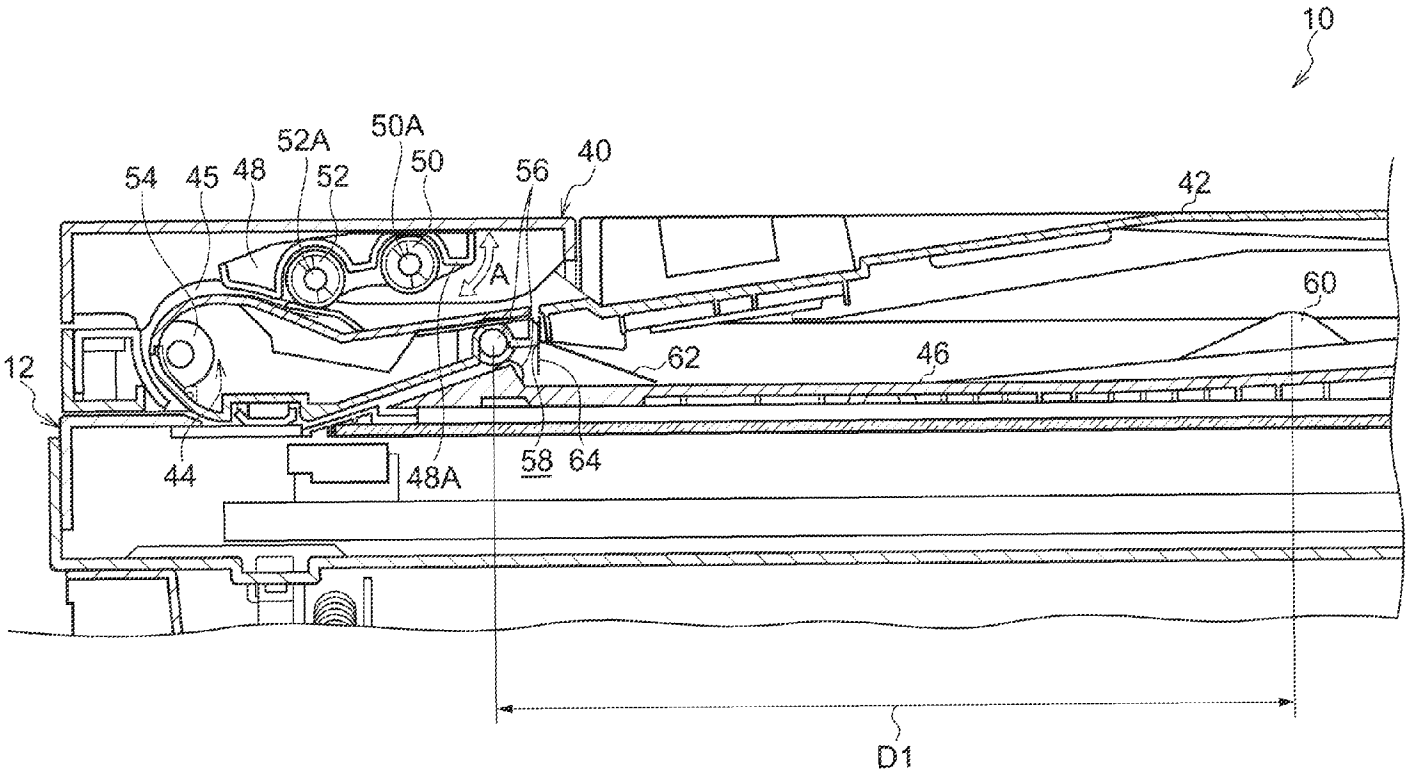
FIG. 3 is a schematic cross sectional view showing a structure of a document transporting section.
Figure 4:
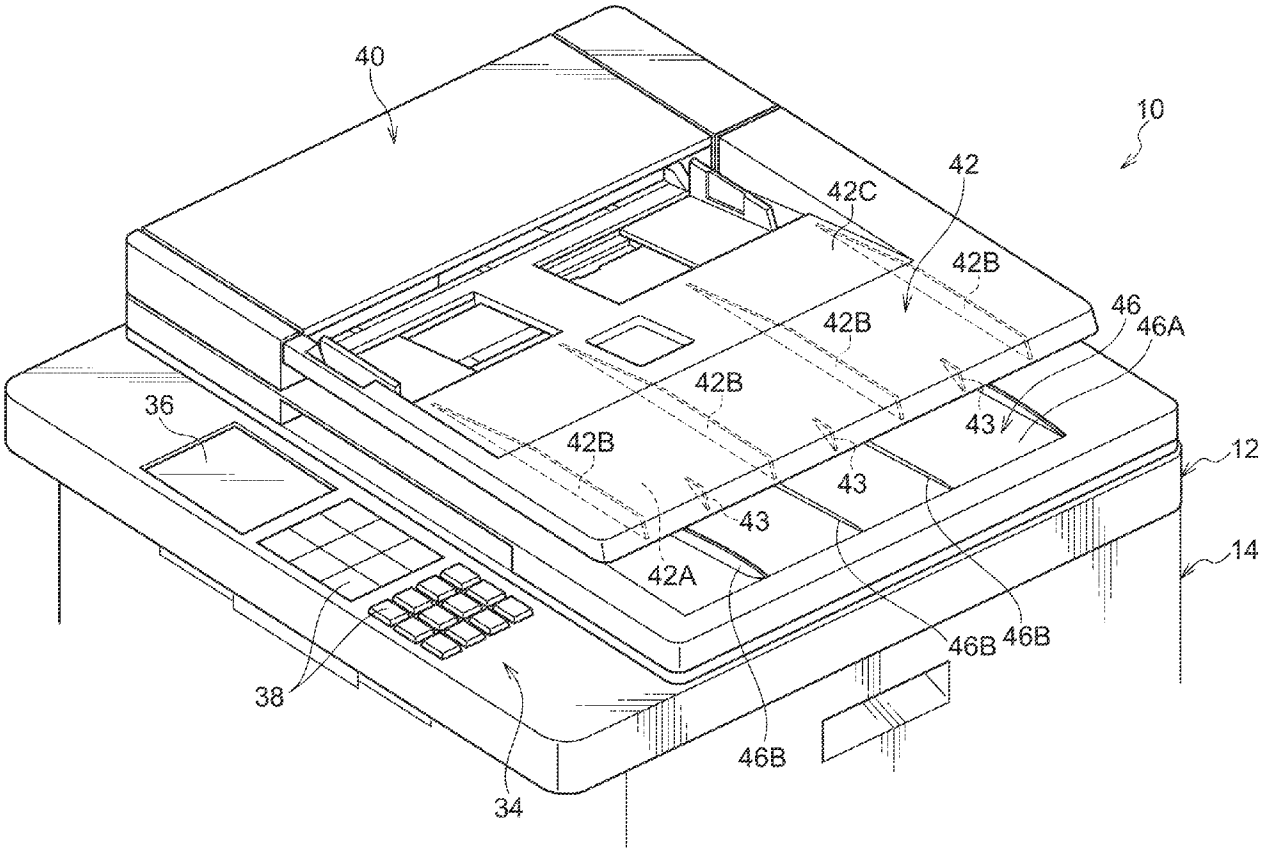
FIG. 4 is a schematic perspective view showing the document transporting section.

The document transporting section 40 is provided at the document reading section 12 at its upper portion. The document transporting section 40 also serves as an opening/closing cover for the document reading section 12. As shown in FIGS. 2 to 4, the document transporting section 40 includes a document accommodating table 42, a transporting mechanism 44 and a document discharge table 46. The document accommodating table 42 serves as one example of the document accommodating section in which the document G whose image information is to be read is accommodated (in a case of plural documents G, they are accommodated in stack manner). The transporting mechanism 44 that transports the document G accommodated on the document accommodating table 42 along a return-shaped transporting path 45. The document discharge table 46 serves as one example of the document discharge section, which is arranged below the document accommodating table 42 and to which the document G transported through the transporting path 45 is discharged.

In other words, the document accommodating table 42 and the document discharge table 46 are collectively arranged on one side of the document transporting section 40 (the right side in FIG. 2). Specifically, the document accommodating table 42 and the document discharge table 46 are arranged so as to be overlapped in the upper and lower (vertical) direction at one side of the document transporting section 40 (the right side in FIG. 2), and an interval in the upper and lower direction between the document accommodating table 42 and the document discharge table 46 is formed so as to be relatively narrow (to the extent such that about 20 plain sheets of document G may be discharged).

A part of an upper surface 42C of the document accommodating table 42 at the feeding direction downstream side is formed as a tilted surface which is a descending slope descending toward the feeding direction of the document G. A part of the upper surface 46A of the document discharge table 46 at the discharge direction downstream side is formed as a tilted surface which is an ascending slope ascending toward the discharge direction of the document G (see FIG. 8).

As shown in FIGS. 2 and 3, the transporting mechanism 44 includes a pickup roll 50, a feeding roll 52, an reversing roll 54, and a pair of discharging rolls 56. The pickup roll 50 is a roll whose outer periphery portion is made of rubber and which picks up the documents G accommodated in the document accommodating table 42 one by one. The feeding roll 52 is a roll whose outer periphery portion is made of rubber and which feeds the document G picked up by the pickup roll 50. The reversing roll 54 returns (U-turns) the document G fed by the feeding roll 52 and reverses the front side and the back side of the document G. The pair of discharging rolls 56 discharges the document G which is reversed the front side/the back side by the reversing roll 54 onto the document discharge table 46.

Thus, the document G is placed on the document accommodating table 42 with the read surface on which the image information to be read is recorded being faced upward, is transported in the feeding direction by the pickup roll 50 and the feeding roll 52, and is reversed the front side/the back side by the transporting path 45 and the reversing roll 54, so the read surface of the document G is faced to the document reading section 12. Then, when the image information recorded on the read surface is read by the document reading section 12, the document G is discharged by the pair of discharging rolls 56 from the discharge port 58, and is discharged (placed) onto the document discharge table 46 with the read surface being faced downward.

The document accommodating table 42 is provided with a sensing section (not shown in the drawings) that senses whether or not the document G is being accommodated. As the sensing section, a light-reflective optical sensor or the like, for example, is used, but a sensor having other configuration may be used. The pickup roll 50 and the feeding roll 52 are housed in a casing 48 with their outer periphery surfaces being exposed. The pickup roll 50 is configured to be revolutionable (rotatably movable) relative to the feeding roll 52 so as to take a contacting position (lower position) contacting with the document G on the document accommodating table 42 and a retracting position (upper position) retracting from (being away from) the contacting position.

In other words, the casing 48 that houses the pickup roll 50 while rotatably supporting the pickup roll 50 is supported so as to be rotatably movable in the arrow A direction (see FIG. 3) with a rotation shaft 52A of the feeding roll 52 as a supporting point. A verge (end) portion 48A (pickup roll 50) at the feeding direction upstream side, where a rotation shaft 50A of the pickup roll 50 is rotatably supported, is always urged toward the retracting position (upward) due to an elastic force of an elastic member (not shown in the drawings) such as extension helical (coil) spring.

The verge portion 48A of the casing 48 rotates and moves downward against the elastic force (urging force) of the elastic member due to a rotational force to the forward direction (the feeding direction of the document G) of the rotation shaft 52A of the feeding roll 52 rotated to drive by a drive source (not shown in the drawings) thereby to rotate and move the pickup roll 50 which is rotatably supported at the verge portion 48A side toward the contacting position.

The rotational drive force of the pickup roll 50 is transmitted from the feeding roll 52 via a gear or the like (not shown in the drawings). The pickup roll 50 may utilize a force which is independent from the feeding roll 52 to be moved to the contacting position or retracting position.

Figure 5:
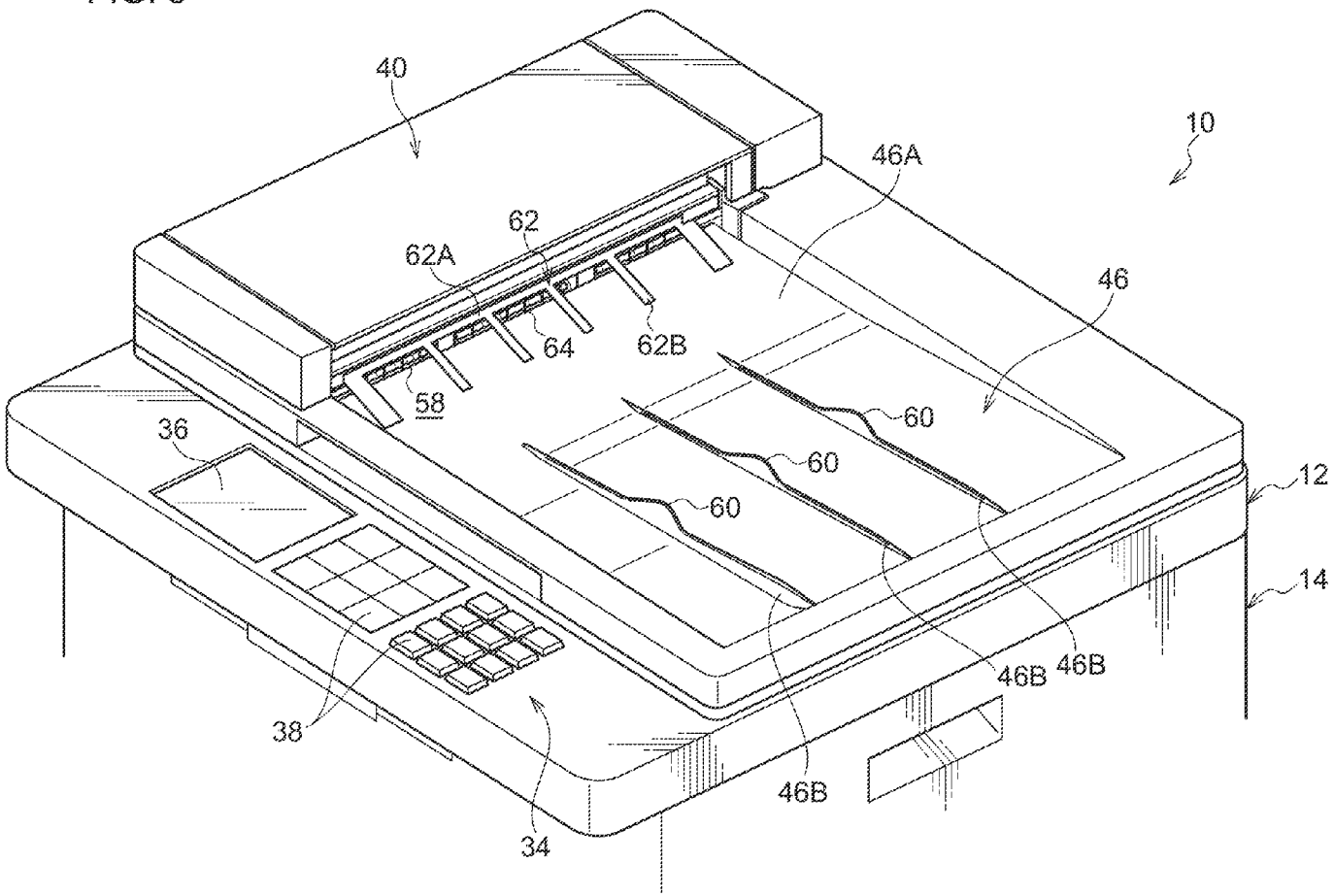
FIG. 5 is a schematic perspective view showing a document discharge table with a document accommodating table removed.
Figure 6:
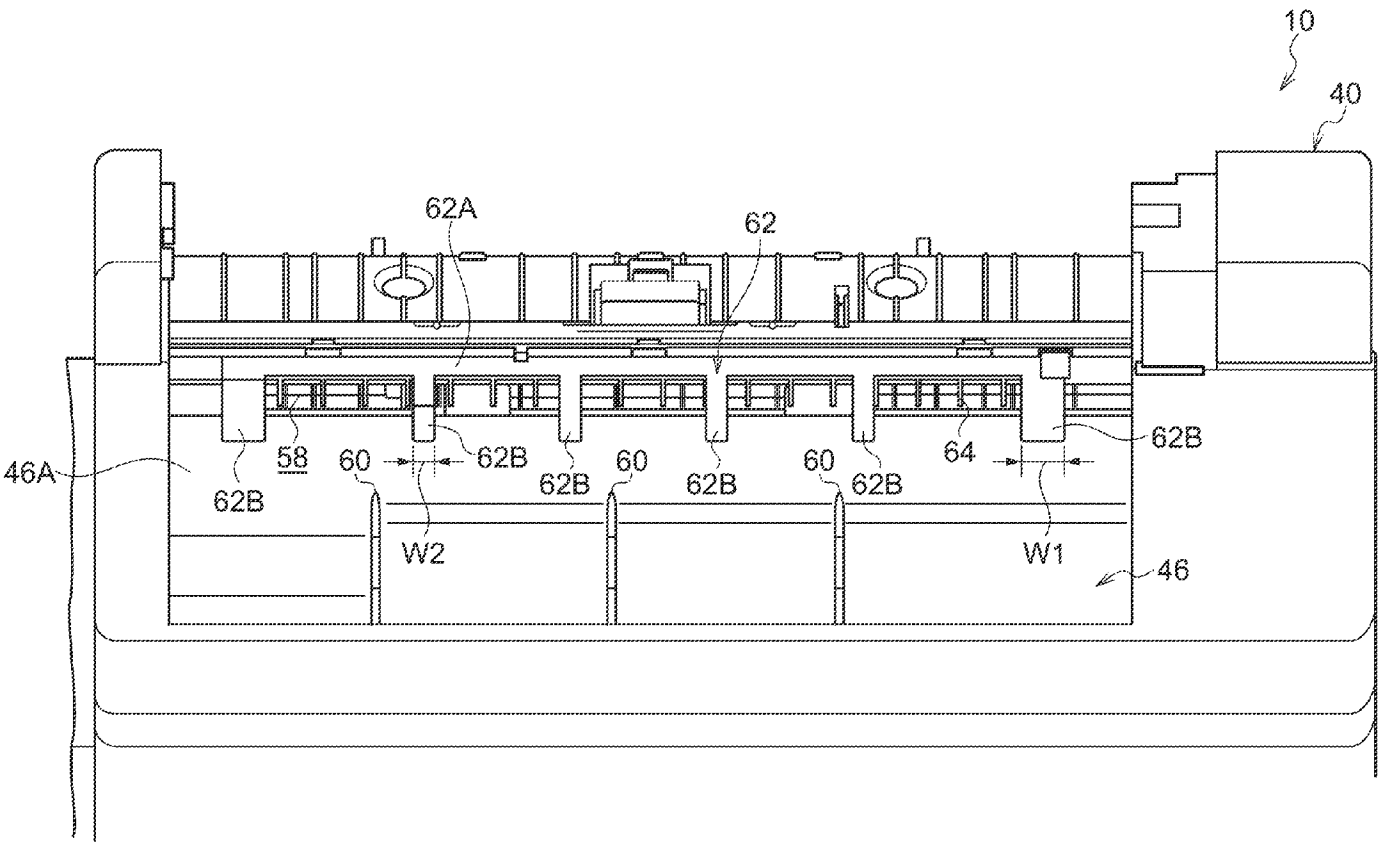
FIG. 6 is a schematic side view showing the document discharge table with the document accommodating section removed.

As shown in FIGS. 4 to 6 in detail, at the upper surface 46A of the document discharge table 46, plural ribs 60 (three in FIG. 5) as one example of protruding portion are provided (formed) in a protruding manner at a predetermined interval therebetween in the axial direction of the discharging roll 56 (in the longitudinal direction of the discharge port 58). A height of a part of each of plural ribs 46B, each of which is formed on the upper surface 46A of the document discharge table 46 in protruding manner so as to extend in the discharge direction, is made higher than the other part such that the ribs 46B are formed integrally with the ribs 60 respectively. The ribs 60 support the discharged document G from below. Instead of the ribs 60, the upper surface 46A of the document discharge table 46 may be the protruding portion (not shown in the drawings) such that the upper surface 46A is protruded along the axial direction of the discharging roll 56 (the longitudinal direction of the discharge port 58).

Each rib 60 is protruded on the tilted upper surface 46A, at a position within a range of ½ to ⅔ of the length of the document discharge table 46 toward the discharge direction from the discharge port 58 of the document discharge table 46 when viewed from the axial direction of the discharging roll 56 (the longitudinal direction of the discharge port 58), for example, the rib 60 is protruded on the tilted upper surface 46A at a position such that a distance D1 (not shown) up to the top (vertex) portion of the rib 60 from the axial center of the discharging roll 56, which is provided at the discharge port 58 (in the vicinity of the discharge port 58), is 180 mm.

(The top of the rib 60 is formed within a range in the document discharge direction from a position a distance to which in the discharge direction from the discharge port 58 is ½ of a length of the document discharge table 46 in the discharge direction to a position a distance to which in the discharge direction from the discharge port 58 is ⅔ of the length of the document discharge table 46 in the discharge direction.)

In the exemplary embodiment, it may be preferable that the length in the discharge direction of the document discharge table 46 is substantially the same as a length of the document G in the discharge direction.

The height H1 of the rib 60 from the upper surface 46A of the document discharge table 46 up to the top thereof (see FIG. 8) is set at about 10 mm, for example. The size of the document G to be discharged onto the document discharge table 46 is for example A4 size which is discharged such that the longitudinal direction of the document is basically as the discharge direction.

Figure 7:
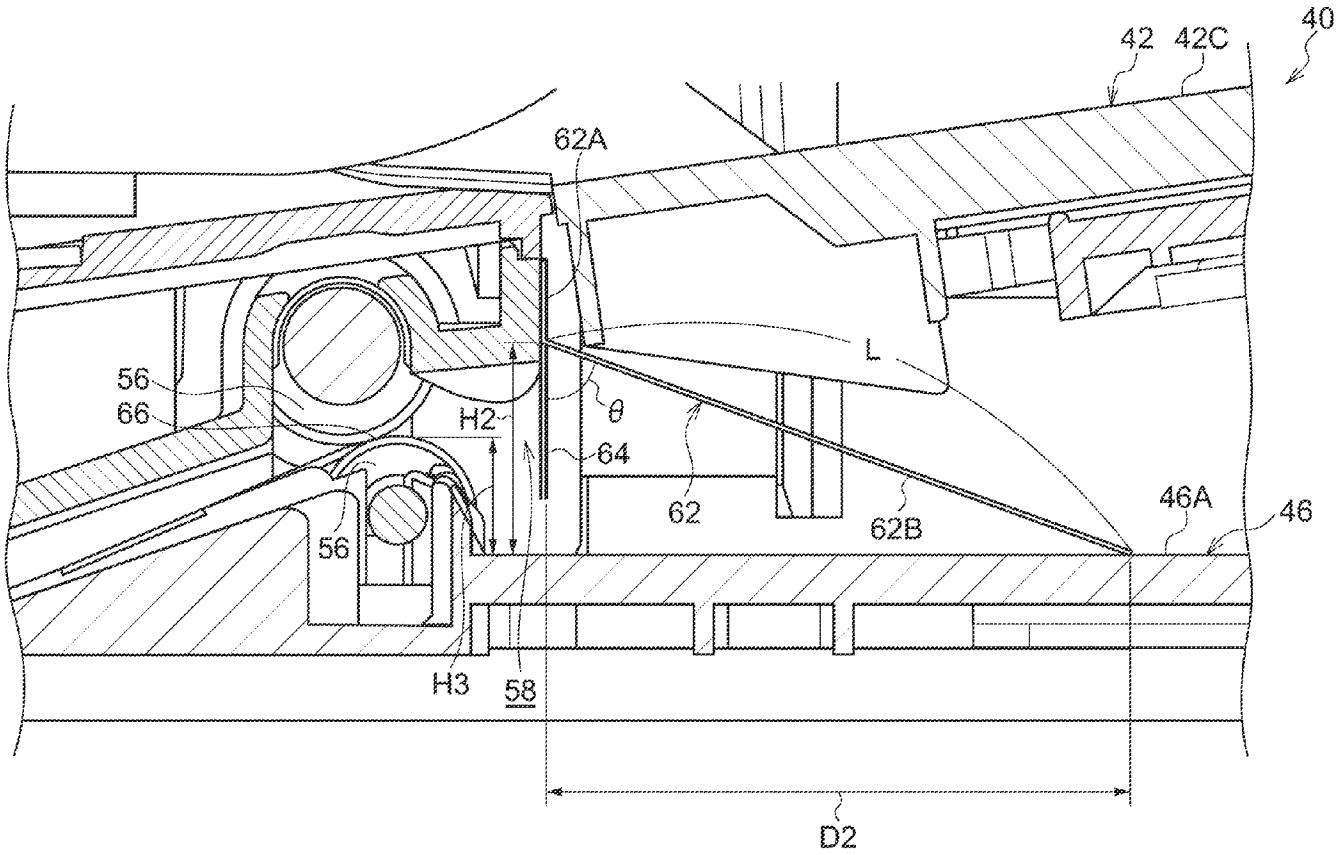
FIG. 7 is a schematic cross sectional view showing a mylar in the document transporting section in an enlarged manner.

As shown in FIGS. 5 to 7, at the discharge port 58, a mylar 62 as one example of the holding (pressing) member that holds down (presses) the document G discharged onto the document discharge table 46 from the above is provided (the mylar 62 also holds down the documents G from above when it is being discharged from the discharge port 58 so as to suppress flutteringly movement of the documents G).

This mylar 62 includes: an attach portion 62A as one example of an upper end which is formed so as to extend in the axial direction of the discharging roll 56 (in the longitudinal direction of the discharge port 58) and is attached on the upper portion side of the discharge port 58 by bonding or adhesion (sticking); and holding portion main bodies 62B which are integrally formed with the attach portion 62A and are arranged at a predetermined interval therebetween in the axial direction of the discharging roll 56 so as to form a comb-teeth shape. A lower end (free end) of the holding portion main body 62B is formed so as to contact with the upper surface 46A of the document discharge table 46 in a case where no document G is present thereon.

In other words, in the mylar 62, an attachment height H2 from the upper surface 46A of the document discharge table 46 near the discharge port 58 up to the attach portion 62A is lower (smaller) than a length L of the comb-tooth shaped holding portion main body 62B and a distance D2 in the discharge direction (horizontal direction) from the attach portion 62A of the mylar 62 up to a position where the upper surface 46A of the document discharge table 46 contacts with the lower end of the holding portion main body 62B, as shown in FIG. 7. Note that in the exemplary embodiment, the height H2 is set as a height from the upper surface 46A of the document discharge table 46 up to the lowest position of a portion of the mylar 62 (the attach portion 62A) where it is attached on the upper portion side of the discharge port 58 by bonding or adhesion (sticking).

More specifically, the attachment height H2 of the mylar 62 is about 17 mm, and the distance D2 in the discharge direction from the attach portion 62A of the mylar 62 up to a position where the upper surface 46A of the document discharge table 46 contacts with the lower end of the holding portion main body 62B is about 40 mm. An angle θ of the holding portion main body 62B of the mylar 62 with respect to the vertical direction is about 70 degrees. A thickness of the mylar 62 is about 0.1 mm, and its material is PET (polyethylene terephthalate).

As shown in FIG. 6, the holding portion main bodies 62B of the comb shaped mylar 62 are configured such that a width Wlof the holding portion main bodies 62B disposed at the both end portions in the axial direction of the discharging roll 56 (longitudinal direction of the mylar 62) is wider than a width W2 of the holding portion main bodies 62B disposed at the other sites. Thus, curl toward upper side at the both end portions in the width direction (front and rear direction of the image forming apparatus 10) of the document G can be appropriately held down (pressed) by the holding portion main bodies 62B of the mylar 62 whose width is larger (that is, W1).

The ribs 60 on the document discharge table 46 are protruded at positions away from the holding portion main bodies 62B of the mylar 62 in the document G discharge direction. Further, the holding portion main bodies 62B and the ribs 60 are arranged to be mutually offset (deviated) in the axial direction of the discharging roll 56 as shown in FIG. 6. Thus, there is configured such that a fold line(s) in the vertical direction (the direction along the discharge direction) is not generated on the document G discharged from the discharge port 58 by the holding portion main bodies 62B of the mylar 62 and the ribs 60.

At the attach portion 62A between the comb-teeth shaped holding portion main bodies 62B of the mylar 62, plural electrical-neutralizing (erasing) brushes 64 which contact with the document G discharged from the discharge port 58 and are which electrical-neutralize (erase) the document G. As shown in FIG. 7, a height H3 of a contacting portion 66 where the outer periphery surfaces of the pair of discharging rolls 56 mutually contact from the upper surface 46A of the document discharge table 46 is about 10 mm, for example, and is set to be the same as the height H1 of the top of the rib 60.

Figure 8:
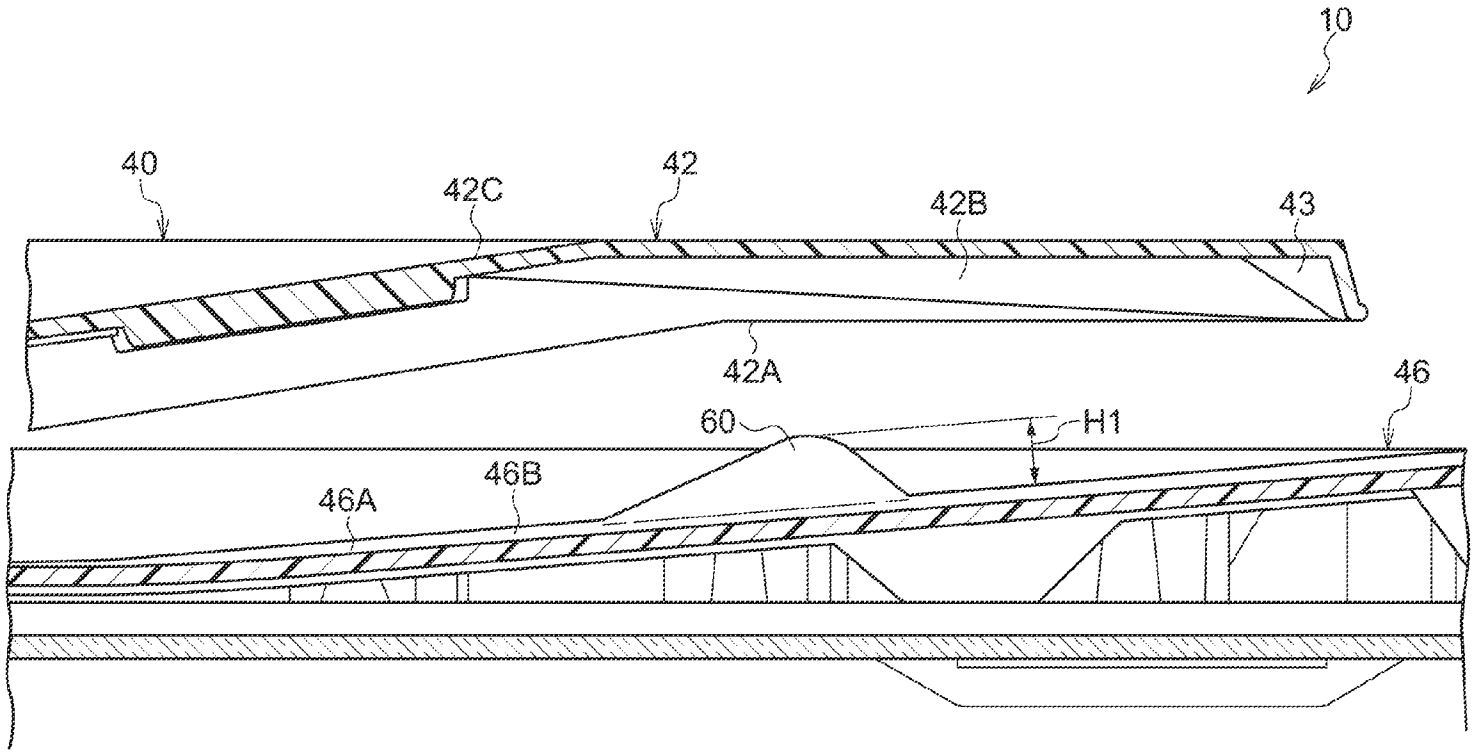
FIG. 8 is a schematic cross sectional view showing a rib in the document transporting section and a rib in the document accommodating section.

As shown in FIG. 8, the lower surface 42A at the document G feeding direction upstream side (the document G discharge direction downstream side) relative to the tilted surface of the document accommodating table 42, which faces the document discharge table 46, is slightly bent toward the document discharge table 46 so as to substantially match with (correspond to) the shape (attitude) of the document G supported by the ribs 60 viewed from the axial direction of the discharging roll 56 (the longitudinal direction of the discharge port 58). Plural ribs 42B are arranged at a predetermined interval therebetween in the axial direction of the discharging roll 56 at the feeding direction upstream side of the lower surface 42A as shown in FIG. 4.

Ribs 43 whose length are shorter than the ribs 42B are arranged in the axial direction of the discharging roll 56 at an end portion of the lower surface 42A in the feeding direction upstream side, each rib 43 being disposed between the corresponding ribs 42B. Even if the width direction both end portions of the document G discharged from the discharge port 58 to the document discharge table 46 are curled upward, the discharge direction downstream side end portion of the document G is guided toward the upper surface 46A of the document discharge table 46 by the respective ribs 42B and 43.

The operations of the image forming apparatus 10 including the document transporting section 40 having the above structure will be described below. At first, an operator operating the image forming apparatus 10 causes the document accommodating table 42 to accommodate the document G with the read surface on which the image information is recorded faced upward. When the document G is accommodated in the document accommodating table 42, the sensing section senses that the document G is "present." Then, when the operator operates the operating section 38, the operation of reading the image information of the document G is started.

That is, the feeding roll 52 is rotated to drive by the drive source, and the verge portion 48A of the casing 48 is rotated and moved downward due to the rotational drive force against the urging force of the elastic member about the rotation shaft 52A of the feeding roll 52, and the pickup roll 50 rotates and moves to the contacting position where it contacts with the document G accommodated in the document accommodating table 42.

At this time, the pickup roll 50 is transmitted the rotational drive force from the feeding roll 52 via the gear or the like (not shown in the drawings). Thus, when the pickup roll 50 rotates and moves to the contacting position and the plural documents G are present, the pickup roll 50 contacting with the uppermost document G picks up the uppermost document G from the document accommodating table 42 and passes it to the feeding roll 52.

The document G picked up by the pickup roll 50 from the document accommodating table 42 and fed by the feeding roll 52 is transported in the transporting path 45 by the transporting mechanism 44 to be reversed the front side/the back side by the reversing roll 54, and the image information recorded on its read surface is read by the document reading section 12.

The document G whose image information recorded on the read surface is read by the document reading section 12 is discharged from the discharge port 58 passing through the contacting portion 66 of the pair of discharging rolls 56, and is discharged (placed) onto the upper surface 46A of the document discharge table 46.

The discharge port 58 is provided with the mylar 62. In other words, the attach portion 62A of the mylar 62 is affixed on the upper portion side of the discharge port 58, the holding portion main body 62B of the mylar 62 is arranged at an angle θ of about 70 degrees relative to the vertical direction, and its lower end (free end) contacts with the upper surface 46A of the document discharge table 46 when no document G is present.

Figure 9:
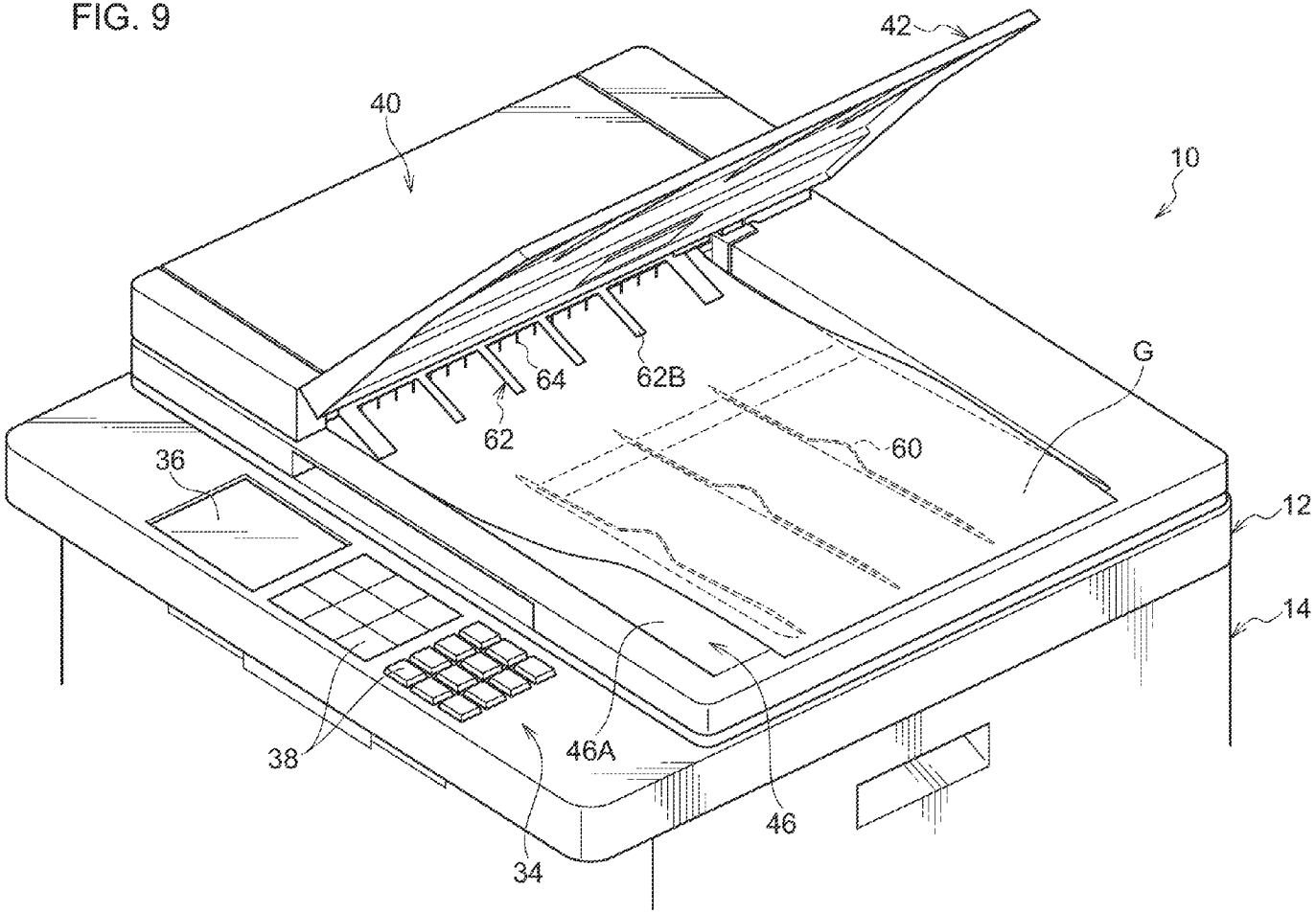
FIG. 9 is a schematic perspective view showing a state in which a document is discharged to the document discharge table.

Thus, as shown in FIG. 9, the document G being discharged from the discharge port 58 is discharged such that the document G is held (pressed) from the above by the holding portion main bodies 62B of the mylar 62, and when the document G has been discharged onto the upper surface 46A of the document discharge table 46, the discharge direction upstream side end portion of the document G is held from the above by the holding portion main bodies 62B.

The plural ribs 60 with the top portions having (substantially) the same height H1 as the height H3 of the contacting portion 66 are protruded side by side at the predetermined interval therebetween in the axial direction of the discharging roll 56 on the tilted upper surface 46A of the document discharge table 46 and at positions within the range from ½ to ⅔ of the length of the document discharge table 46. Thus, as shown in FIG. 9, the positions at the discharge direction downstream side relative to the intermediate portions (the positions within the range of ½ to ⅔ of the length of the document discharge table 46) of the document G discharged onto the upper surface 46A of the document discharge table 46 are supported by the ribs 60 from the below.

That is, since the document G at the discharge direction upstream side end portion is held from the above by the holding portion main bodies 62B of the mylar 62, the document G is discharged onto the upper surface 46A of the document discharge table 46 in a state of a upwardly-convex curved shape such that the position at the discharge direction downstream side relative to the intermediate portion thereof (the position within the range of ½ to ⅔ of the length of the document discharge table 46) becomes the top portion when viewed from the axial direction of the discharging roll 56 (the longitudinal direction of the discharge port 58). Thus, the ability of accommodating the documents G discharged onto the upper surface 46A of the document discharge table 46 can be enhanced.

In other words, the document G discharged onto the document discharge table 46 has a upwardly-convex curved shape such that the position at the discharge direction downstream side relative to the intermediate portion (the position within the range of ½ to ⅔ of the length of the document discharge table 46) becomes the top portion when viewed from the axial direction of the discharging roll 56, deformation of the document G in which the width direction both end portions of the document G are curled upward when viewed from the discharge direction of the document G can be corrected. Additionally, the holding portion main bodies 62B at the longitudinal direction both end portions of the mylar 62 are formed to be wider, thereby properly holding the width direction both end portions of the document G.

In other words, according to the exemplary embodiment, curl at the discharge direction downstream side of the document G is more easily corrected compared with a case where the top portion of the rib 60 is protruded at a position which is further discharge direction upstream side than a position of a half of the length of the document discharge table 46. Further, according to the exemplary embodiment, since the curved position is closer to the discharge direction upstream side of the document G than a case where the top of the rib 60 is protruded at a position which is further discharge direction downstream side than a position of ⅔ of the length of the document discharge table 46, the curved shape can be easily formed due to weight of the documents G and thus the curl at the discharge direction downstream side of the documents G is easily corrected.

Thus, there are not failures such that "the width direction both end portions of a previously-discharged document G are curled upward, so the discharge direction downstream side end portion of a later-discharged (subsequently discharged) document G hits with the width direction both end portions which are curled of the previously-discharged document G to push the previously-discharged document G toward the discharge direction outer side (downstream side), so that error of discharged location (undesired displacement) of the document G occurs, or so that the previously-discharged document G is dropped from the upper surface 46A of the document discharge table 46 due to remarkable error of discharged location of the document G (accordingly, the order of the discharged documents G goes out of order due to the drop)".

There are shown in the table 1 the result obtained by a measurement in which a pushing amount by which a later-discharged document G actually pushes a previously-discharged document G is measured for "a case in which the mylar 62 is not provided", "a case in which the angle θ of the holding portion main body 62B of the mylar 62 is set to be 40 degrees" and "a case in which the angle θ of the holding portion main body 62B of the mylar 62 is set to be 70 degrees", respectively. In each of the cases, measurement (experiment) is performed five times. From the table 1, it is judged that the pushing amount by which the later-discharged document G pushes the previously-discharged document G, which pushing amount is the average-value in the five times-measurement, is minimum when the mylar 62 is provided and its angle θ is set at 70 degrees.

That is, since there is no member which holds down the discharge direction upstream side end portion (the rear end of the previously-discharged document G) from the above in a case in which the mylar 62 is not provided, the discharge direction downstream side end portion (the leading end) of the later-discharged document G is hit with the discharge direction upstream side end portion (the rear end) of the previously-discharged document G and consequently the previously-discharged document G is pushed.

In a case in which the angle θ of the holding portion main body 62B of the mylar 62 is set at 40 degrees (that is, in a case of the mylar 62 in which the length (distance) D2 in the discharge direction of the document G from the attachment position of the holding portion main body 62B (the attach portion 62A of the mylar 62) to the lower end of the holding portion main body 62B is shorter than the attachment height H2 of the holding portion main body 62B (the height H2 of the attach portion 62A of the mylar 62)), the discharge direction upstream side end portion (the rear end) of the previously-discharged document G can be held from the above, while the length L of the holding portion main body 62B of the mylar 62 is shorter than that in the case in which the angle θ of the holding portion main body 62B of the mylar 62 is set at 70 degrees so that the holding force by the mylar 62 becomes stronger.

Thus, in the case of "40 degrees", the discharge direction downstream side end portion (the leading end) of the document G is not discharged (moved) up to the normal (regular) position with passing through the ribs 60 due to a resistance caused by the holding force of the mylar 62, and consequently the discharge direction downstream side end portion (the leading end) of the later-discharged document G hits with the discharge direction upstream side end portion (the rear end) of the previously-discharged document G and pushes the previously-discharged document G

TABLE 1

| | No mylar Pushing amount (mm) | Mylar of 40 degrees Pushing amount (mm) | Mylar of 70 degrees Pushing amount (mm) |
|---|---|---|---|
| First time | 60 | 10 | 25 |
| Second time | 55 | 10 | 0 |
| Third time | 55 | 15 | 0 |
| Fourth time | 60 | 10 | 0 |
| Fifth time | 60 | 25 | 35 |

In this way, since the document G is suppressed or prevented from dropping from the document discharge table 46, an extend discharge table (not shown in the drawings) as drop-preventing auxiliary mechanism for the document G does not need to be slidably provided on the document discharge table 46. Thus, the manufacture cost of the document transporting section 40 can be reduced. Further, the installation area of the entire image forming apparatus 10 including the document transporting section 40 can be reduced.

When the image information recorded on the read surface of the document G is read by the document reading section 12, the main body 14 is operated by the controlling section 30 so that an image is formed on a recording sheet P. In other words, the surface of the photoreceptor drum is uniformly charged by the charging roll and a light beam corresponding to an output image is irradiated from the exposing device 20 on the charged surface of the photoreceptor drum so that an electrostatic image is formed.

The developing device gives a toner to the electrostatic image so that a toner image is formed on the photoreceptor drum and the toner image is transferred onto the recording sheet P by the transfer roll. Thereafter, the recording sheet P is sent to the fixing device 26 and the toner image is fixed. Then, the recording sheet P on which the toner image is fixed is discharged from the discharge port 32 onto the cover member 28.

The document transporting device (the document transporting section 40) and the image forming apparatus 10 according to the exemplary embodiment are described with reference to the example shown in the drawings, but the document transporting device and the image forming apparatus 10 according to the exemplary embodiment are not limited to the illustrated example. For example, in the comb-teeth shaped holding portion main bodies 62B of the mylar 62, only the widths of the holding portion main bodies 62B at the longitudinal direction both end portions of the mylar 62 are wider than widths of the holding portion main bodies 62B in other sites, but the widths of the all holding portion main bodies 62B may be formed to be "wide width" which are same as the widths of the holding portion main bodies 62B at the longitudinal direction both end portions of the mylar 62.

Instead of making the widths of the holding portion main bodies 62B at the longitudinal direction both end portions of the mylar 62 to be wider than widths of the holding portion main bodies 62B in other sites, only the holding portion main bodies 62B at the longitudinal direction both end portions of the mylar 62 are each configured such that plural (for example, two) holding portion main bodies 62B are piled up to increase the holding force, thereby appropriately holding the upwardly curls of the width direction both end portions of the document G by the piled holding portion main bodies 62B. Further, the document transporting device according to the exemplary embodiment may be applied to a so-called a scanner or facsimile device.

The invention claimed is:

1. An image forming apparatus comprising:

a document transporting device comprising:

a document accommodating section in which a document is accommodated;

a transporting mechanism configured to transport the document accommodated in the document accommodating section along a transporting path;

a document discharge section to which the document transported in the transporting path by the transporting mechanism is discharged;

a protruding portion that is formed in a center portion of the document discharge section in a longitudinal direction of a discharge port, and that extends in a discharge direction of the discharged document, the discharge direction of the document being substantially perpendicular to the longitudinal direction of the discharge port; and a holding member comprising:

an attach portion that is attached at an upper side of the discharge port from which the document is discharged to the document discharge section; and a holding portion configured to hold down the document discharged on the document discharge section from above;

wherein:

the holding portion is integrally formed with the attach portion, and the holding portion is disposed so as to contact at least end portions of the document and a center portion of the document in the longitudinal direction of the discharge port, a document reading section that reads image information of the document transported by the transporting mechanism of the document transporting device; and an image forming section that forms an image on a recording medium based on the image information read by the document reading section, wherein the attach portion extends in the longitudinal direction of the discharge port such that the attach portion has a length substantially the same as a length of the discharge port in the longitudinal direction of the discharge port, and wherein the holding member, that is configured to include the holding portion disposed so as to contact the at least end portions of the document, and the attach portion, is a single piece member.

* * * * *